United States Patent [19]

Keene

[11] 3,948,356

[45] Apr. 6, 1976

[54] POWER MODULE AND CASTER SUPPORTED LOAD SUPPORTING FRAME

[75] Inventor: Derek K. Keene, Philadelphia, Pa.

[73] Assignee: Eaton Corporation, Cleveland, Ohio

[22] Filed: Feb. 1, 1974

[21] Appl. No.: 438,814

[52] U.S. Cl. ..... 187/9 R; 214/730; 180/14 R

[51] Int. Cl.[2] ..... B66B 9/20

[58] Field of Search ..... 180/11–14 R, 180/98; 214/660, 670–674; 280/423–425; 187/9 R

[56] References Cited

UNITED STATES PATENTS

| | | | |
|---|---|---|---|
| 770,936 | 9/1904 | Simpson | 180/11 |
| 1,418,842 | 6/1922 | Staude | 180/14 R |
| 1,952,730 | 3/1934 | Remde | 180/11 |
| 3,179,196 | 4/1965 | Richardson | 180/14 R |
| 3,199,622 | 8/1965 | Cook | 180/14 R |
| 3,272,365 | 9/1966 | Stevens | 187/9 X |
| 3,376,990 | 4/1968 | Latall | 180/13 |
| 3,472,408 | 10/1969 | Hendricks et al. | 214/674 |
| 3,563,397 | 2/1971 | Bause | 187/9 X |
| 3,763,955 | 10/1973 | Schroder et al. | 180/98 |
| 3,768,586 | 10/1973 | Thompson et al. | 180/98 |

*Primary Examiner*—Robert J. Spar
*Assistant Examiner*—R. B. Johnson
*Attorney, Agent, or Firm*—Teagno & Toddy

[57] ABSTRACT

A material handling vehicle system comprising a universal power module and a plurality of interchangeable load handling modules. The load handling modules disclosed include two forms of order pickers, a double masted stacker, and a towing attachment. The connection between the load handling module and the power modules is designed to maintain a constant force on the steering wheels of the power module regardless of the load on the load handling module, and to facilitate changing from one load handling module to another.

3 Claims, 6 Drawing Figures

POWER MODULE AND CASTER SUPPORTED LOAD SUPPORTING FRAME

The present invention relates to material handling vehicles, and more particularly to a system of material handling vehicles including a power module and a plurality of load handling modules.

In modern warehousing it is often necessary to provide several different kinds of material handling vehicles, such as manned order pickers, automated stackers, load carrying trailers, and the like. To provide a plurality of specialized vehicles for each of the above features is generally expensive and inefficient since often only one vehicle can be used at any given time. The present invention contemplates the use of a single power module and a plurality of load handling modules.

There are several problems associated with the use of a single power module and a plurality of accessory modules such as contemplated herein. Particularly if the power module is of a type which is unmanned the different loadings which the use of different accessory modules can produce on the steered wheels of the power module can cause serious control problems. An example of an unmanned vehicle is disclosed in U.S. Pat. No. 3,768,586, issued oct. 30, 1973, and assigned to the assignee of the present invention. It should be noted that while the present invention is illustrated herein as incorporating an unmanned power module it will become apparent that the invention is equally applicable to manned units.

Another problem associated with the use of a common power module and a family of accessory modules is that the theoretical advantages of such a system can be negated unless the modules are so designed that switching from one module to another can be accomplished quickly and easily using a minimum of specialized tools and hardware.

Accordingly, it is an object of this invention to provide a system of material handling vehicles comprising a power module and a plurality of load handling modules.

Another object of the invention is to provide such a vehicle system in which the load handling modules are quickly and easily attached to and detached from the power module.

Another object of the invention is to provide a vehicle system as described above in which the load on the steered wheels of the power module is maintained essentially constant, independent of the particular accessory module employed and independent of the load on a particular accessory module.

To meet the above objectives the present invention provides a material handling vehicle system comprising a power module and a plurality of accessory or load handling modules. The power module includes all components necessary to propel and control the vehicle and includes power take-off means necessary to power certain of the accessory modules. A variety of accessory modules can be included; however, for purposes of illustration there is disclosed herein different forms of order picker modules, a stacker module, and a module which can be used to convert a power module in a towing tractor vehicle.

In order to provide ease of switching from one module to another, as well as to provide the desired loading characteristics, a particular type of connection is provided between the power module and the accessory modules. This connection includes a swivel mounting between the drive or trail axle of the power module and the accessory module which insures that the load imparted by the accessory module to the power module is always directly over the trail axle of the power module, thus maintaining a constant load on the steered wheels of the power module.

Other objects and advantages of the invention will be apparent from the specification when taken in connection with the accompanying drawings, wherein.

Figure 1:
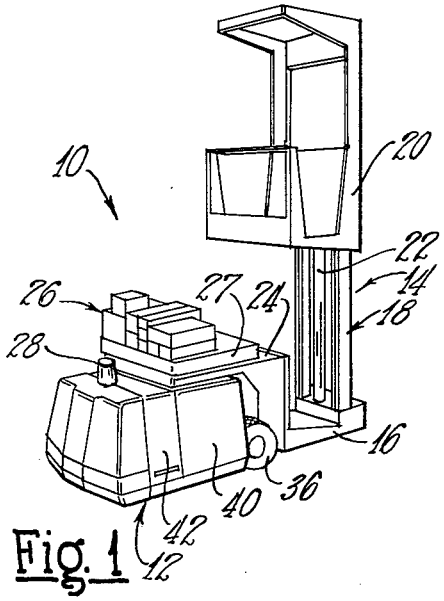
FIG. 1 is a perspective view of one typical vehicle of the inventive system comprising a power module and an order picker module.

Referring to FIG. 1, a typical vehicle 10 of the system comprises a power module 12 and a load handling module 14. As shown, the power module 12 is of a type which is unmanned and which is programmed to follow a guide wire buried in the floor of a warehouse; however, it will be apparent that the present invention is equally applicable to manned vehicles.

In the embodiment illustrated in FIG. 1 the load handling module 14 is of a type generally referred to as an order picker and comprises a frame 16, connected at one end to the power module 12 by means which will be described in detail below, and supported at the opposite end by caster wheels (not shown), a vertically extending mast structure 18, and an operator's platform 20 movable along the mast by means of a hydraulic cylinder 22 or the like. The order picker module 14 further includes a stationary load carrying table 24 fixed to the frame 16. For purposes of illustration a typical load is shown as comprising a variety of articles 26 supported on a pallet 27. In a typical warehousing operation an operator standing on the platform 20 pulls articles 26 from storage bins, then lowers the platform to deposit the articles on table 24. When an order is filled the vehicle is moved to a transfer area where the table 24 is cleared. When the power module 12 is unmanned a warning flasher 28 may be included as part of the module.

Figure 2:
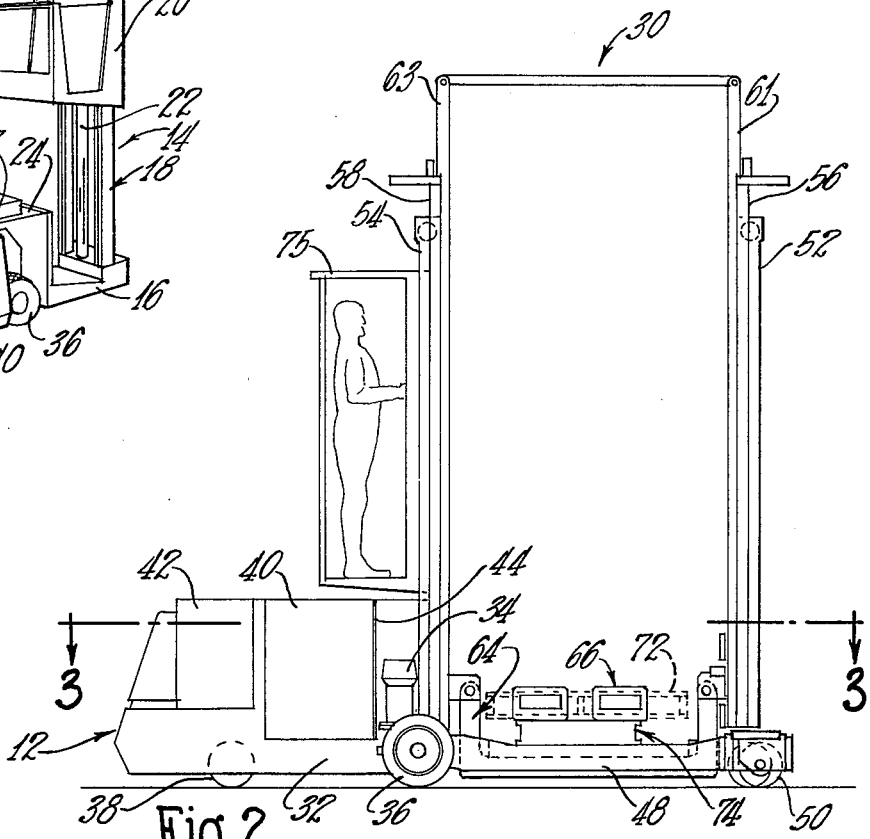
FIG. 2 is a side elevation view of another typical vehicle of the system comprising a power module and a stacker module.
Figure 3:
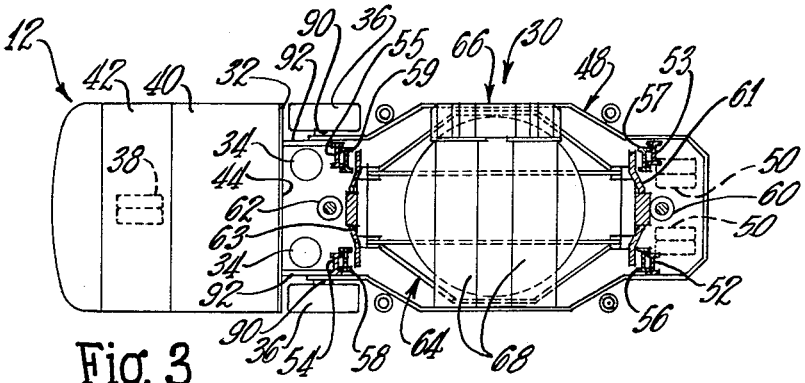
FIG. 3 is a sectional view taken along line 3—3 of FIG. 2.

Referring particularly to FIGS. 2 and 3, the power module 12 will be described in more detail as it is depicted in these figures as part of a vehicle which includes a load handling module 30 in the form of a stacker.

The power module 12 includes all the components necessary to propel and control the vehicle, comprising generally a frame 32, dual propulsion motors 34, trailing drive wheels 36 and forward steering wheels 38. Although not restricted thereto the illustrated power module is fully electric and includes a battery compartment 40 and a control component compartment 42. A manual control panel at 44 can also be provided. The power module also includes a hydraulic system which can be driven by the propulsion motors 34 or by separate motors (not shown) to provide power take-off means for the various load handling modules. The hydraulic connections (not shown) between the power module and the load handling modules can be of a quick-disconnect type well known in the art and will not be described in detail herein. Similar electrical connections can also be provided to provide power for any electrical components of the load handling modules.

The stacker module 30 comprises a frame 48 connected at its forward end to the power module 12 and supported at the rear end by spaced caster wheels 50. Because of its size the stacker module includes a pair of dual caster wheels; however, it can be appreciated that single caster wheels or pairs of single caster wheels can be used depending on the size of the module.

The stacker module illustrated includes pairs of stationary masts 52, 53 and 54, 55 extending vertically from the frame 48, pairs of intermediate movable masts 56, 57 and 58, 59, and a pair of movable load carrying mast structures 61, 63 in nested relation to one another and mounted for vertical movement relative to the stationary masts. Hydraulic cylinders 60 and 62 connected between the frame 48 and the movable masts provide extension of the movable masts relative to the stationary masts in a conventional manner.

A sub frame structure 64 suspended between the movable mast structures 61 and 63 defines a load carriage and supports a shuttle assembly designated generally by the numeral 66. The shuttle assembly is conventional and will not be described in detail; however, it generally comprises a pair of load supporting forks 68, which can be extended outward to the side of the vehicle to remove a load from a storage bin or deposit it therein. As illustrated in FIG. 2 the forks 68 are adapted to fit within a standard pallet 72. A rotator assembly 74 may be provided to provide access to either side of an aisle without repositioning the entire vehicle. Movement of the sub frame 64 relative to the movable mast structures 61 and 63 can be provided by separate hydraulic cylinders connected between the sub frame and the masts, or by a system of chains or cables in conjunction with the cylinders 60 and 62 similar to the system used in conventional fork lift trucks to provide free lift of the load carriage. Such systems are conventional and will not be described in detail herein. A stationary operator's platform 75 is attached to the stationary masts 54 and 55 to provide a control station for operation of the load carriage and masts and the shuttle assembly. While operation of the load handling module only is generally provided on the operator's platform 75, additional controls for the power module could also be provided with some modification.

Figure 4:
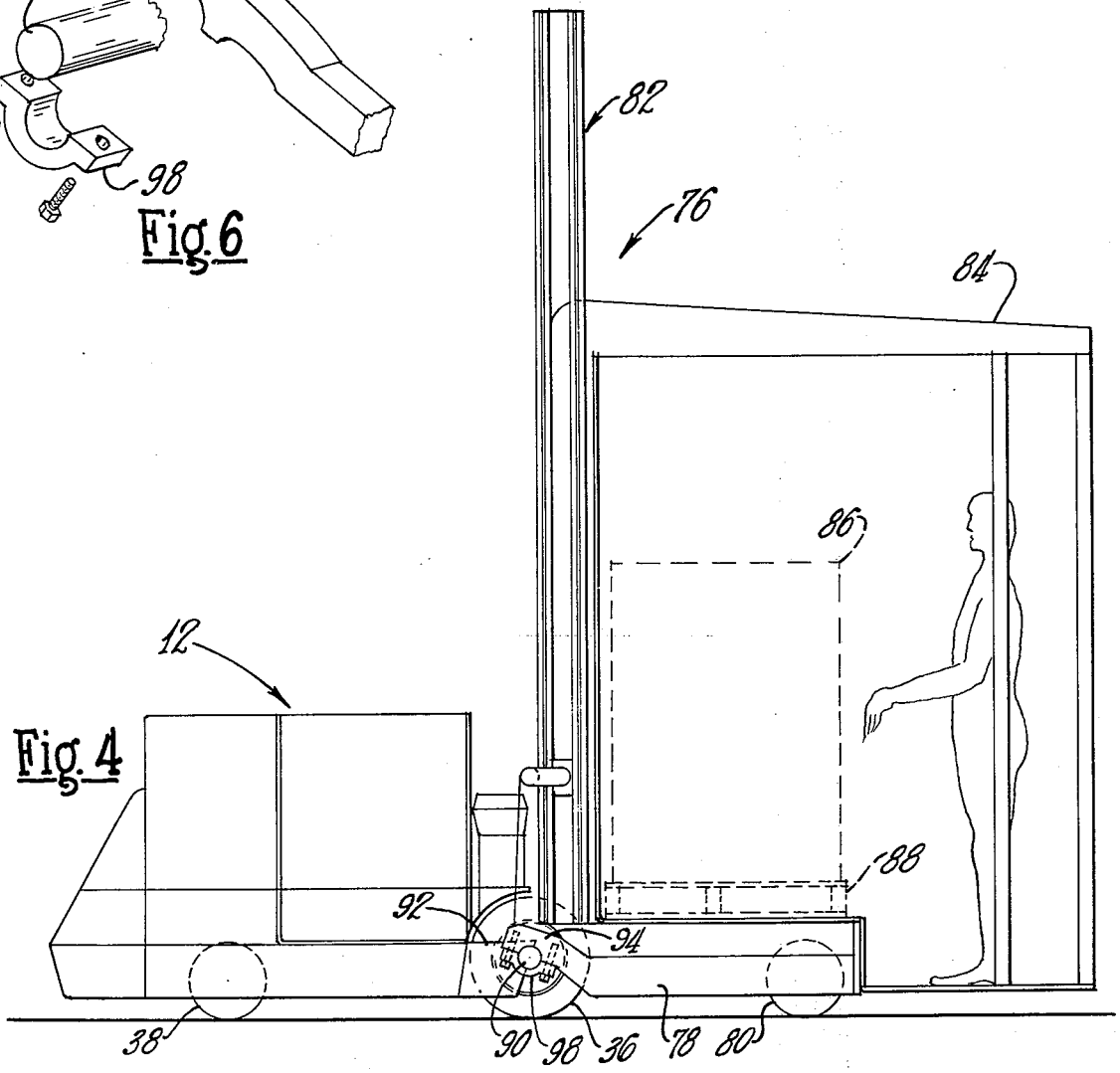
FIG. 4 is a side elevation view of another typical vehicle of the system comprising a power module and another form of order picker module shown with some parts removed for clarity.

Referring to FIG. 4, another form of load handling module, designated generally by the numeral 76, is shown attached to a power module 12. This module, which is another form of order picker, comprises a frame 78 connected at one end to the power module 12 and supported at the opposite end by caster wheels 80, a vertically extending mast structure 82, and a combined operator and load platform 84. In operation the load handling module 78 performs similarly to module 14 illustrated in FIG. 1 except that the load 86, shown supported on a standard pallet 88, moves with the operator on platform 84 along mast structure 82. Details of the mast structure and the connection of the platform thereto are all conventional.

Figure 6:
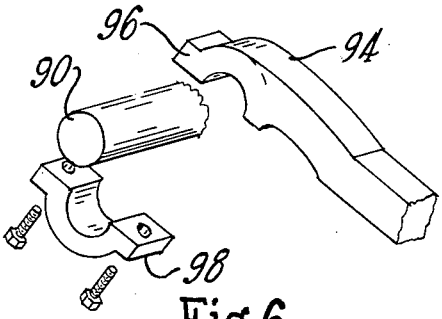
FIG. 6 is a partial perspective view schematically illustrating a typical connection between a load handling module and a power module.

Each of the load handling modules illustrated in FIGS. 1 to 4 connects to the power module 12 by means which provide excellent interchangeability of load modules and excellent loading characteristics, among other advantages. Referring particularly to FIGs. 4 and 6, the connection between each of the load handling modules and the power module is illustrated.

As shown in FIG. 3 the drive wheels 36 of the power module 12 are supported by stub axles 90 which are welded or otherwise fastened to rearwardly extending frame members 92 of the power module. Referring to FIG. 4, which depicts the power module 12 with the near drive wheel 36 removed, forwardly extending rail member sections 94 of the frame 78 are received on the stub axles 90 in the area between the frame members 92 and the drive wheel 36.

FIG. 6 depicts schematically the manner in which the rail sections 94 are received on the stub axles. In the illustrated area the stub axle 90 is machined or otherwise finished to form a bearing journal to receive the end of the rail 94, which is formed into a yoke 96. A bearing cap 98 is bolted to the yoke to surround the stub axle.

The journal area of the stub axle 90 and the yoke 96 and bearing cap 98 are sized so that the yoke and bearing cap structure pivots freely about the stub axle, thus providing a pivotal connection between the power module 12 and the load handling module 76.

Referring particularly to FIG. 4, it can be appreciated that as a result of the pivotal connection between the load handling module and the power module, which connection is located directly over the drive wheel axis, the load transferred from the load handling module to the power module has a component only in the vertically downward direction through the drive wheel axis. Accordingly, the load on the steering wheels 38 remains constant regardless of the load carried by the load handling module. This load characteristic is especially important when the power module is unmanned since the essentially constant steering force which results greatly simplifies the servo steering control provided with this type of vehicle. Such loading is also beneficial in manned vehicles in a similar manner in that any steering system in which the steering forces can be readily predicted is much simpler to design and operate than a system in which the steering forces vary, possibly over quite a wide range depending on the load handling module used and the load carried thereby.

Figure 5:
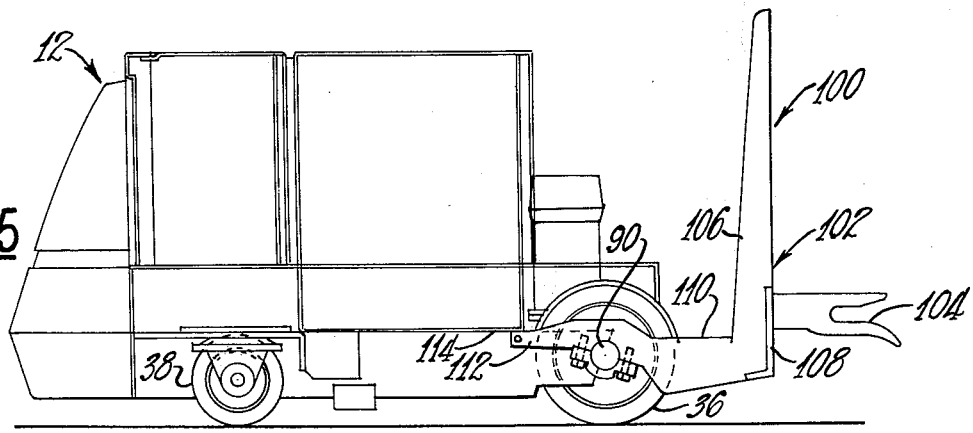
FIG. 5 is a side elevation view of another vehicle of the system, with parts removed, comprising a power module and means to adapt the power module for use as a towing vehicle.

In FIG. 5 there is illustrated a modification of the present system which adapts the power module 12 for use as a towing tractor. The towing module, designated generally by the numeral 100 comprises a frame 102 and a towing hook 104 attached to the frame.

The frame 102 comprises a pair of spaced L-shaped members 106 (one of two shown) connected by a crossmember 108. The towing hook 104 is bolted or otherwise fastened centrally on the crossmember. A floorplate 110 is located between the frame members 106 and serves as an operator's platform if the power module is operated as a manned vehicle.

The attachment of the towing module 100 to the power module 12 is somewhat different from that of the other modules because of the different loading on the module. Since the towing module has no rear caster wheels it must be supported entirely by the power module 12. As shown in FIG. 5 each horizontal leg of the frame member 106 includes an extended portion 112 extending well forward of the stub axle 90 of the power module. The frame 102 is attached to the stub axle by means of the same type of yoke and cap construction as the other modules; however, it is positioned by blocking the extended portions 112 against the lower surfaces of frame members 114 of the power module. The yoke portion and cap can be sized such that they clamp tightly against the stub axle 90, or they can be rotatable as in the other modules.

It can be appreciated that the towing module 100, by its nature, does not impart a load component vertically through the axle 90 only as do the other modules. While the weight of the module and of an operator does impart a clockwise moment about the axles 90, there will be no load component of the towed load acting on the steering wheels 38 and the effect on the steering wheels will be relatively slight and essentially constant throughout a given operating cycle of the vehicle, and should not adversely effect steering. This is particularly true if the vehicle is unmanned, when the steering force is most critical.

In operation, a single power module 12 can be used in conjunction with several different load handling modules to serve various needs in a warehouse operation. By connecting the load handling modules to the power module by means of the yoke connection disclosed herein the critical steering load on the power module is not affected by the type of load handling module employed or by the load carried thereby. The power module is designed such that the connecting point, the rear drive axle of the power module, is at the extreme rear of the power module, thus facilitating switching from one load handling module to another. The actual connection is secured by two bolts on either side of the vehicle and a changeover from one load handling module to another can generally be accomplished by one man.

I claim:

1. A material handling vehicle comprising a power module, said power module including a frame, at least one steerable wheel supported by said frame adjacent the forward end of said power module, at least one drive motor supported by said frame adjacent the rear end of said power module, a pair of drive wheels operatively connected to said drive motor, and a pair of coaxial stub axles attached to said frame and supporting said drive wheels; and a load handling module, said load handling module comprising a frame, an elevatable load receiving and operator's platform mounted on said frame, at least one caster wheel attached to the frame of said load handling module adjacent one end of said module, and means for supporting the opposite end of said load handling module on said power module; the improvement comprising cylindrical bearing surfaces coaxial with the axis of rotation of said drive wheels formed on portions of said stub axles extending laterally relative to the frame of said power module, and a pair of yoke members extending from the frame of said load handling module defining said means for supporting the opposite end of said load handling module, said yoke members having cylindrical bearing surfaces formed thereon complemental to and received by said bearing surfaces on said stub axles, at least a major portion of said load receiving platform being located between said at least one caster wheel and said bearing surfaces formed on said yoke members, the major portion of the load carried by said load platform transferred to said power module being supported by said power module on a line extending through the axis of rotation of said drive wheels with the load on said steerable wheel remaining substantially constant regardless of the load carried on said load receiving platform.

2. A material handling vehicle as claimed in claim 1, in which said stub axles are mounted at the extreme ends of rearwardly projecting extensions of the frame of said power module, and said yoke members are formed at the extreme ends of forwardly projecting extensions of the frame of said load handling module.

3. A material handling vehicle as claimed in claim 1, in which each of said yoke members includes a cap member having a cylindrical bearing surface formed thereon complemental to and engageable with the bearing surface on said stub axle, said cap member being attachable to said yoke member to form a bearing encircling said stub axle to retain said load handling module in coupled engagement with said power module.

* * * * *